US005219113A

United States Patent [19]

Noé

[11] Patent Number: 5,219,113

[45] Date of Patent: Jun. 15, 1993

[54] METHOD AND ARRANGEMENT FOR STRETCH BENDING OF METAL STRIP

[75] Inventor: Oskar Noé, Mülheim, Fed. Rep. of Germany

[73] Assignee: BWG Berwerk-und Walzwerk-Maschinenbau GmbH, Duisberg, Fed. Rep. of Germany

[21] Appl. No.: 774,083

[22] Filed: Oct. 9, 1991

[30] Foreign Application Priority Data

Jul. 26, 1991 [DE] Fed. Rep. of Germany ..... 4124800

[51] Int. Cl.[5] ..... B21D 3/12; B21C 47/26; B23K 37/00

[52] U.S. Cl. ..... 228/5.7; 228/173.7; 72/161; 72/205

[58] Field of Search ..... 228/15.1, 17, 5.7, 173.7, 228/173.6, 171, 5.7; 72/205, 160, 161

[56] References Cited

U.S. PATENT DOCUMENTS

| | | | |
|---|---|---|---|
| 3,191,843 | 6/1965 | Tomkins | 228/5.7 |
| 3,700,157 | 10/1972 | Shumaker | 228/5.7 |
| 3,867,826 | 2/1975 | Noé | 72/205 |
| 3,924,428 | 12/1975 | Noé | 72/161 |
| 4,188,812 | 2/1980 | Nomura et al. | 72/203 |
| 4,299,103 | 11/1981 | Marten | 72/205 |
| 4,558,578 | 12/1985 | Noé | 72/205 |
| 4,651,549 | 3/1987 | Masui | 72/161 |
| 5,161,400 | 11/1992 | Lefor | 72/205 X |

FOREIGN PATENT DOCUMENTS

| | | | |
|---|---|---|---|
| 55-77927 | 6/1980 | Japan | 72/161 |

*Primary Examiner*—Richard K. Seidel
*Assistant Examiner*—Jeanne M. Elpel
*Attorney, Agent, or Firm*—Anderson Kill Olick & Oshinsky

[57] ABSTRACT

A method and an arrangement for the treatment of metal strip, particularly for the treatment of hot-rolled metal strip in an entry portion of a pickling line through which the metal strip travels continuously. The method includes straightening the metal strip which is being uncoiled from an uncoiling reel under a predetermined strip tension, then severing the unstraightened ends of the strip for producing straightened ends of the strips, and subsequently connecting the strip end of an advancing metal strip to a strip end of a subsequent metal strip. Immediately after being uncoiled, the metal strip is straightened by stretch-bending and a strip tension is produced which is sufficiently high for straightening by stretch-bending without increasing the uncoiling tension.

8 Claims, 1 Drawing Sheet

METHOD AND ARRANGEMENT FOR STRETCH BENDING OF METAL STRIP

BACKGROUND OF THE INVENTION

1. Field of the Invention

The present invention relates to a method for the treatment of metal strip, particularly for the treatment of hot-rolled metal strip in the entry portion of a pickling line through which the metal strip travels continuously. The method includes straightening the metal strip which is being uncoiled from an uncoiling reel under a predetermined strip tension, subsequently severing the unstraightened ends of the strip for producing straightened ends of the strip, and subsequently connecting the strip end of an advancing metal strip to the strip end of a subsequent metal strip.

The present invention further relates to an arrangement for carrying out the above-described method.

2. Description of the Related Art

It is known in the art to place in the entry portion of a pickling line the metal strip from an uncoiling reel over a guide roller onto the intended pass line and to supply the metal strip to a shearing machine over drivers and a prestraightening machine and finally to supply the strip to a connecting unit, for example, a welding machine. In the welding machine, the end of an advancing metal strip is connected by means of welding to the end of a subsequent metal strip. It is the purpose of the prestraightening machine to straighten the metal strip in the pass line after it had been introduced into the pass line.

However, the prestraightening machine can reduce waviness of the strip only to a small extent. The prestraightening machine has no influence on saber-shaped strip portions. In addition, it is not possible to produce high strip tensions in the prestraightening machine, for example, by high braking tensions at the uncoiling reel. This is because particularly hot-rolled coils are not sufficiently tightly coiled because of the waviness of the strip.

In order to eliminate strip waviness, such as, border undulations, trough-shaped strip portions or the like and to reduce or eliminate saber-shaped strip portions or horizontal curvatures, it is known in the art to cause the connected metal strips to travel after welding through a stretch-bending unit. However, an entry portion of the above-described type has the disadvantage that the metal strips in the welding machine are still wavy and still have trough-shaped strip portions which are particularly pronounced at the strip ends. Therefore, it is not possible to exactly center the strip ends to be connected. Rather, the strip ends are welded to each other more or less in inclined relative positions. In fact, wavy metal strips are upset in the welding clamps and are not welded with the full cross-section. Accordingly, the strip connection can tear totally or partially in the subsequent stretch-bending machine.

Another problem is the fact that wavy metal strips produce substantial noise when they travel through the treatment or pickling line, i.e., when traveling around the rollers, such as guide rollers, straightening rollers, drive rollers, tensioning rollers, etc.

SUMMARY OF THE INVENTION

Therefore, it is the object of the present invention to provide a method and an arrangement for the treatment of metal strip, particularly of hot-rolled metal strip in the entry portion of a pickling line through which the metal strip travels continuously, of the above-described type, in which metal strips can be straightened and connected to each other in a simple manner without problems.

In accordance with the present invention, in the method of the above-described type, the metal strip is straightened by stretch-bending immediately after being uncoiled and a strip tension is produced which is sufficiently high for the straightening by stretch-bending without increasing the uncoiling tension.

The present invention starts from the finding that, on the one hand, strip waviness, such as border undulations, trough-shaped portions or the like as well as saber-shaped portions and horizontal curvatures can be substantially reduced or eliminated by subjecting the strip to straightening by stretch-bending, and that, on the other hand, the straightening by stretch-bending can be carried out immediately after uncoiling of the metal strip and, thus, before centering and welding the strip ends to be connected. This, in turn, results in an exact centering of the strip ends to be connected and in an exact welding of the strip ends over the full cross-section of the strip, so that there is no longer the danger that the strip connections will totally or partially tear in the treatment or pickling line. Moreover, the problem-free straightening of the metal strips by straightening by means of stretch-bending results in an improved and essentially noise-free guidance of the strip because the strip waviness which would produce noise during deflections around rollers is eliminated.

In accordance with a preferred embodiment of the invention, the metal strip is temper-rolled without deflection during the generation of the strip tension immediately before being straightened by stretch-bending. This feature of the invention provides that the formation of stretcher strains, such as, roll buckling, straightening roller breaks or the like can be avoided already with relatively small degrees of temper rolling of about 0.5% to 1.5% in dependence on the thickness of the strip and the material coefficients. During the subsequent straightening step by means of stretch-bending with degrees of stretching of 0.5% to 1.5%, stretcher strains no longer occur. In addition, straightening by stretch-bending has the result that the metal is not susceptible to stretcher strains because of alternating partially plastic bending. This is of great significance because of the continuously increasing production of hot-rolled and pickled metal strip, particularly since subsequent deformations can again lead to stretcher strains if the metal strip is only temper-rolled. This is because temper-rolling only prevents stretcher strains in the areas near the surface of the strip.

The arrangement for carrying out the method according to the present invention, particularly an entry portion of a pickling line for continuously traveling metal strip, includes an uncoiling reel, at least two drivers, a straightening unit, a shearing unit and a strip connecting unit, for example, a welding machine.

In accordance with the present invention, immediately following the uncoiling reel in travel direction of the strip are arranged a braking driver, a tension driver and a stretch-bending unit between the braking driver and the tension driver.

Within the scope of the invention, the tension driver and the braking driver produce high strip tensions required for straightening the respective metal strip by stretch-bending, for example, strip tensions of 20 ton to 50 ton with strip thicknesses of 1.0 mm to 6.0 mm and strip widths of 500 mm to 2000 mm, while taking into consideration the respective material coefficients. The non-straightened strip ends are severed in the subsequent shearing unit. The uncoiling tension at the uncoiling reel may be kept small or near zero, so that damage to the strip surfaces cannot occur, for example, due to slipping of the strip coils relative to each other.

In accordance with another feature of the present invention, the braking driver may be a temper-rolling stand, for example, a two-high stand, or a four-high stand. In this regard, the present invention further recommends that the uncoiling reel and the temper-rolling stand are arranged in the intended pass line of the respective metal strip, i.e., actually a tangential strip travel from the uncoiling reel into the braking driver or the temper-rolling stand is achieved without deflection, in order to prevent the formation of stretcher strains. A unit for removing scale dust may additionally be provided at the stretch-bending unit.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

The single Figure of the drawing is a schematic sectional view of an arrangement for the treatment of metal strip according to the present invention.

DESCRIPTION OF THE PREFERRED EMBODIMENT

Figure 1:
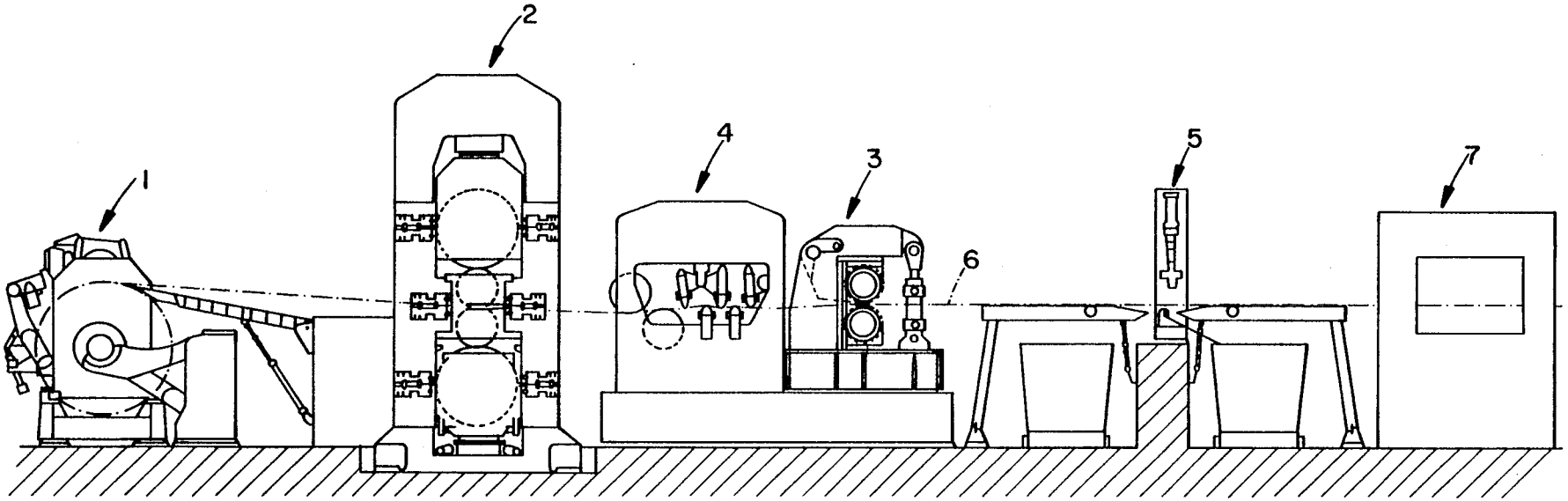

The Figure of the drawing shows the entry portion of a pickling line for continuously traveling metal strip. The entry portion includes an uncoiling reel 1 a braking driver 2, a tension driver 3 and a stretch-bending unit 4 between the braking driver 2 and the tension driver 3. In the illustrated embodiment, the braking driver 2 is a temper-rolling stand.

A shearing unit 5 for cropping the strip end and the strip beginning of the metal strip 6 traveling through the arrangement is provided following the tension driver 3 in travel direction of the strip. The shearing unit 5 is followed by a welding unit 7 for connecting or welding together the strip end of the advancing metal strip and the strip beginning of the subsequent metal strip. The welding unit 7 is only schematically illustrated in the drawing.

Generally, in the arrangement according to the present invention, the metal strip 6 can be straightened by stretch-bending in the stretch-bending unit 4 after being uncoiled from the uncoiling reel 1. The strip tension which is sufficiently high for the straightening by stretch-bending is produced by the tension driver 3 and the braking driver 2 without increasing the uncoiling tension. The braking driver 2 may be constructed as a temper-rolling stand. Consequently, the metal strip 6 is temper-rolled without deflections during the generation of the strip tension. After temper-rolling, the metal strip 6 is subject to stretch-bending by stretch-bending unit 4 under metal strip tension caused by tension driver 3 and brake driver 2.

The uncoiling reel 1 and the temper-rolling stand 2 are arranged in the intended pass line of the respective metal strip, so that the metal strip is supplied without deflections to the temper-rolling stand 2.

While a specific embodiment of the invention has been shown and described in detail to illustrate the application of the inventive principle, it will be understood that the invention may be embodied otherwise without departing from such principles.

I claim:

1. A method for the treatment of metal strip, particularly for the treatment of hot-rolled metal strip in an entry portion of a pickling line through which the metal strip travels continuously, providing the steps of:

straightening the metal strip which is being uncoiled from an uncoiling reel under a predetermined strip tension;

subsequently severing unstraightened ends of advancing and subsequent metal strips for producing straightened ends of the strip;

subsequently connecting a strip end of an advancing metal strip to a strip end of a subsequent metal strip;

wherein straightening the metal strip is affected by stretch-bending immediately after the metal strip has been uncoiled; and includes producing a strip tension which is sufficiently high for straightening by stretch-bending, without increasing the uncoiling tension.

2. An entry portion of a pickling line for continuously traveling metal strip, comprising:

an uncoiling reel;

a braking device;

a tension drive;

a stretch-bending unit between the braking device and the tension driver;

a cutting unit; and a strip connecting unit.

3. The entry portion of claim 2, wherein the strip connecting unit is a welding unit.

4. The entry portion of claim 2, wherein the braking device is a temper-rolling stand.

5. The entry portion of claim 4, wherein the temper-rolling stand is a two-high stand.

6. The entry portion of claim 4, wherein the temper-rolling stand is a four-high stand.

7. The entry portion of claim 4, wherein the uncoiling reel and the temper-rolling stand are arranged in an intended pass line of the metal strip.

8. A method for the treatment of metal strip, particularly for the treatment of a hot-rolled metal strip in an entry portion of a pickling line through which the metal strip travels continuously, providing the steps of:

uncoiling the metal strip from, an uncoiling reel;

producing a strip tension which is sufficiently high for straightening by stretch-bending, without increasing the uncoiling tension;

temper-rolling the metal strip without deflection during production of the strip tension;

immediately thereafter, stretch-bending the metal strip;

subsequently severing unstraightened ends of advancing and subsequent metal strips for producing straightened ends of the strip; and subsequently connecting a strip end of an advancing metal strip to a strip end of a subsequent metal strip.

* * * * *